US006595716B1

(12) United States Patent
VanDeVyvere et al.

(10) Patent No.: US 6,595,716 B1
(45) Date of Patent: Jul. 22, 2003

(54) CAM LEVER ASSEMBLY FOR MANHOLE CENTER

(75) Inventors: Bryan VanDeVyvere, Lee's Summit, MO (US); Henry Knaack, Jr., Gladstone, MO (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/662,948

(22) Filed: Sep. 15, 2000

(51) Int. Cl.[7] ..... B65D 90/10
(52) U.S. Cl. ..... 404/26; 52/20
(58) Field of Search ..... 404/25, 26; 52/19, 52/20; 220/263, 264; 292/256.5, 257

(56) References Cited

U.S. PATENT DOCUMENTS 1,664,972 A * 3/1928 Dudderar ..... 292/257
2,324,356 A * 7/1943 Brown ..... 292/257
3,744,670 A * 7/1973 De Frees ..... 220/57
4,157,146 A * 6/1979 Svenson ..... 292/257
4,248,160 A * 2/1981 Carney, Jr. et al. ..... 105/377
4,388,873 A * 6/1983 Carleton et al. ..... 202/257
4,441,431 A * 4/1984 Carney, Jr. et al. ..... 220/314
4,543,889 A * 10/1985 Fritz ..... 220/314
4,570,816 A * 2/1986 Ferris et al. ..... 220/314
4,729,584 A * 3/1988 Beckerer, Jr. ..... 292/257
4,768,675 A * 9/1988 Coleman ..... 220/203
4,934,715 A * 6/1990 Johnson ..... 52/20
5,158,022 A * 10/1992 Dugge et al. ..... 220/314
5,366,317 A * 11/1994 Solimar ..... 404/25
5,368,347 A * 11/1994 Holtman et al. ..... 292/257
5,394,650 A * 3/1995 Dean ..... 52/20
5,438,935 A * 8/1995 Seitz ..... 105/377.11
5,960,980 A * 10/1999 Burke et al. ..... 220/325
6,076,471 A * 6/2000 Burian et al. ..... 105/358
6,095,365 A * 8/2000 Yielding ..... 220/264

* cited by examiner

*Primary Examiner*—Robert E. Pezzuto
*Assistant Examiner*—Alexandra K. Pechhold
(74) *Attorney, Agent, or Firm*—Jones, Walker, Waechter, Poitevent, Carrere & Denegre, L.L.P.

(57) ABSTRACT

A sealable manhole system having a weld ring, a cover with a gasket shaped to engage the weld ring, and a cam lever assembly. The cam lever assembly comprising includes a cam lever having a cam surface and a pivot aperture. A pivot pin is sized to engage the pivot aperture and has a screw aperture formed there through. A connector operatively attached to the weld ring and an adjustment screw passes through the screw aperture and engages the connector. The cover further includes a gasket channel with a neck and an internal shoulder formed above the neck. The internal shoulder further has a dimension wider than the neck and is oriented at an angle to the neck.

13 Claims, 7 Drawing Sheets

CAM LEVER ASSEMBLY FOR MANHOLE CENTER

BACKGROUND OF THE INVENTION

The present invention relates to manholes in large container vehicles for dry bulk products. In particular, the present invention relates to locking levers and sealing gaskets for securing the cover on such manholes.

Container vehicles such as railcars and truck trailers used for transporting dry bulk products such as grains or powdered cement typically have manhole access ports on their top sides which allow workers to climb into the container vehicle and inspect or clean the interior of the container. Normally to unload a container vehicle, pressurized air is applied to the interior of the container and the products are carried by the escaping air through an outlet located near the bottom of the container. Naturally, the manholes must be sealed while the container vehicle is being unloaded to prevent air from exiting the manhole cover rather than the intended container outlet. Also, when transporting cargo, it is desirable to maintain an air tight seal in order to prevent contamination of the cargo by outside elements and moisture. A typical system for covering and sealing the manhole is seen in FIGS. 1–3. FIG. 1 illustrates a typical dry bulk container vehicle 100. FIG. 1 shows how container vehicle 100 will have one or more manholes 1. FIG. 2A illustrates prior art manhole 1 in greater detail. A cylindrical weld ring 3 will surround the opening in the container vehicle and be welded to the body of the vehicle. A cover 2 will be attached to weld ring 3 by way of hinge 4 as best seen in the side view of FIG. 2B. It can be seen in FIG. 2B that a gasket 6 is positioned around an underside perimeter of cover 2 and will rest on the upper edge of weld ring 3. It will be understood that gasket 6 forms a seal between the upper edge of weld ring 3 and cover 2. FIG. 3 shows how gasket 6 will be position in a gasket channel 7 with inwardly sloping sidewalls 8.

FIG. 2A illustrates how a series of cam lever assemblies 10 will be positioned around the outside perimeter of cover 2. Each cam lever assembly 10 will have a cam handle 11 and a forked end 17 opposite handle 11. Each prong of forked end 17 will have a pin aperture 22 formed therein and will also include a cam surface 18 formed on the lower portion of the prong. As best seen in the cross-section view of FIG. 3, an adjusting screw 12 is pinned between the prongs by a pivot pin 13. Adjusting screw 12 extends through cover 2 and engages jam nut 14 and connector 15. It will be understood that jam nut 14 acts as a locking mechanism and will not allow downward travel of screw 12 when jam nut 14 is positioned against connector 15. FIG. 2A illustrates how connector 15 will be connected to weld plate 3 by way of brackets 25 and clevis pin 20. Returning to FIG. 3, it can be visualized how the rotation of adjusting screw 16 will raise or lower cam surface 18 and cause cam surface 18 to place either more or less pressure on cover 2. Typically, a wear plate 19 is positioned on cover 2 and provides the actual surface which cam surface 18 engages. Wear plate 19 may be constructed of a wear resistant and rust resistant material such as stainless steel and operates to prevent the frictional force of cam surface 18 from damaging cover 2. Wear plate 19 may be screwed to cover 2 (see FIG. 2A) in order that it may be easily replaced when it becomes excessively worn.

FIG. 2A best illustrates how locking lever assembly 10 operates to hold cover 2 tightly closed against weld ring 3.

One lever handle 11A is shown rotated back and completely removed from engagement with cover 2. When it is desired to place pressure on cover 2, the cam lever handle is placed in the upper position as shown by lever handle 11C. At this point, cam surface 18 has not engaged wear plate 19 and forced cover 2 downward. As cam handle 11C is rotated forward, cam surface 18 begins to engage wear plate 19 and exert a downward force on cover 2. When cam lever handle 11C is rotated fully forward as shown by cam lever handle 11B, a flat portion of cam surface 18 rests upon wear plate 19 and tends to resist upward rotation of cam lever handle 11. Over time, wear plate 19 and gasket 6 may become worn. To maintain a proper seal between weld ring 3 and gasket 6, it will be necessary to press cover 2 further downward or in other words, bring cam surface 18 closer to connector 15. This may be accomplished by positioning the cam lever handles as seen for handle 11C. Handle 11C may then be rotated which will cause adjusting screw 12 to travel further down the threaded surface of connector 15. This results in cam surfaces 18 being moved correspondingly closer to connector 15. Therefore, when handle 11C is rotated forward in the closed position, cam surface 18 will apply a greater downward force to wear plate 19 and thus press gasket 6 more firmly onto weld ring 3.

FIG. 2A also shows safety catch 23. Safety catch 23 rotates over wear plate 19 as suggested by viewing the safety catch 25 shown on handles 11A and 11B. The purpose of safety catch 23 is to prevent cover 2 from being "blown" open if the container is pressurized when all cam handles 11 are released. If air pressure is pushing cover 2 upward, safety catch 23 is engaged by wear plate 19 and cannot be rotated backwards. It is necessary for pressure to bleed off and cover 2 to rest on weld ring 3 before safety catch 23 may rotate backwards. Normally, only one cam lever assembly 10 will have a safety catch 23. FIG. 2A illustrates two safety catches 23 in order to show one in the rotated backwards (open) position and one in the rotated forward (closed) position. There are several disadvantages to the prior art cam lever assembly 10. First, adjusting screw 12 may only be rotated when handle 11 is not in the forward or locked position. Thus, to adjust screw 12, handle 11 must be lifted and the downward force on wear plate 19 released. If cover 2 is forming a pressure seal with weld ring 3, releasing force on wear plate 19 may undesirably allow gases within the container vehicle to escape. Second, when handle 11 is rotated, it must be rotated in complete revolutions in order for handle 11 to be able to rotate forward to the locked position. Thus, if the desired adjustment is ½ a turn of adjustment screw 12 or 1½ turns, this cannot be achieved. Adjustment screw 12 must be turned in increments of 360 degrees, even if this causes cam surface 18 to place more or less force on wear plate 19 than is desired. Placing to little force prevents the formation of an effective pressure seal. On the other hand, placing too much tends to damage and shorten the life of gasket 6.

Other problems also arise with the prior art gasket 6. As gaskets become old, they tend to stick to the rim of weld ring 3 and are too easily pulled out of gasket channel 7. Attempts have been made to fix gasket 6 in channel 7 with an adhesive, but this creates its own set of problems. For example, adhesives which are not evenly applied may form lumps under gasket 6, lessening the gasket's ability to seal uniformly. Moreover, when it becomes necessary to replace gasket 6, gasket 6 may tear and leave segments of the gasket still glued within channel 7. This necessitates the time consuming task of clearing out all the small bits of the old gasket remaining in channel 7 before the new gasket may be inserted. It would be a significant advance in the art to provide a cam lever assembly and gasket which overcomes the above described disadvantages.

SUMMARY OF THE INVENTION

The present invention provides a sealable manhole system having a weld ring, a cover with a gasket shaped to engage said weld ring, and a cam lever assembly. The cam lever assembly comprising includes a cam lever having a cam surface and a pivot aperture. A pivot pin is sized to engage the pivot aperture and has a screw aperture formed there through. A connector operatively attached to the weld ring and an adjustment screw passes through the screw aperture and engages the connector.

The invention further includes a sealable manhole system having a weld ring and a cover with a gasket shaped to engage the weld ring, and a cam lever assembly. The cover further includes a gasket channel with a neck and an internal shoulder formed above the neck. The internal shoulder further has a dimension wider than the neck and is oriented at an angle to the neck.

DETAILED DESCRIPTION OF THE INVENTION

Figure 1:
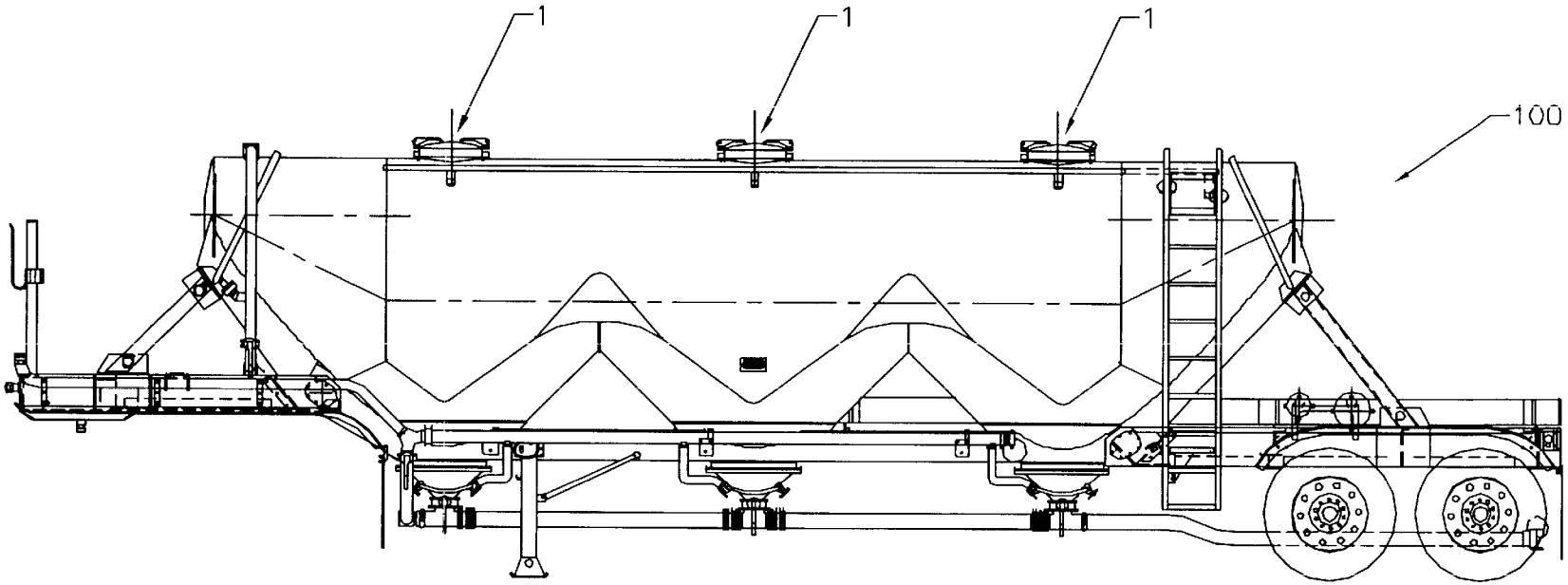
FIGURE 1 PRIOR ART
FIG. 1 is a side view of a typical dry bulk container vehicle.
Figure 2A:
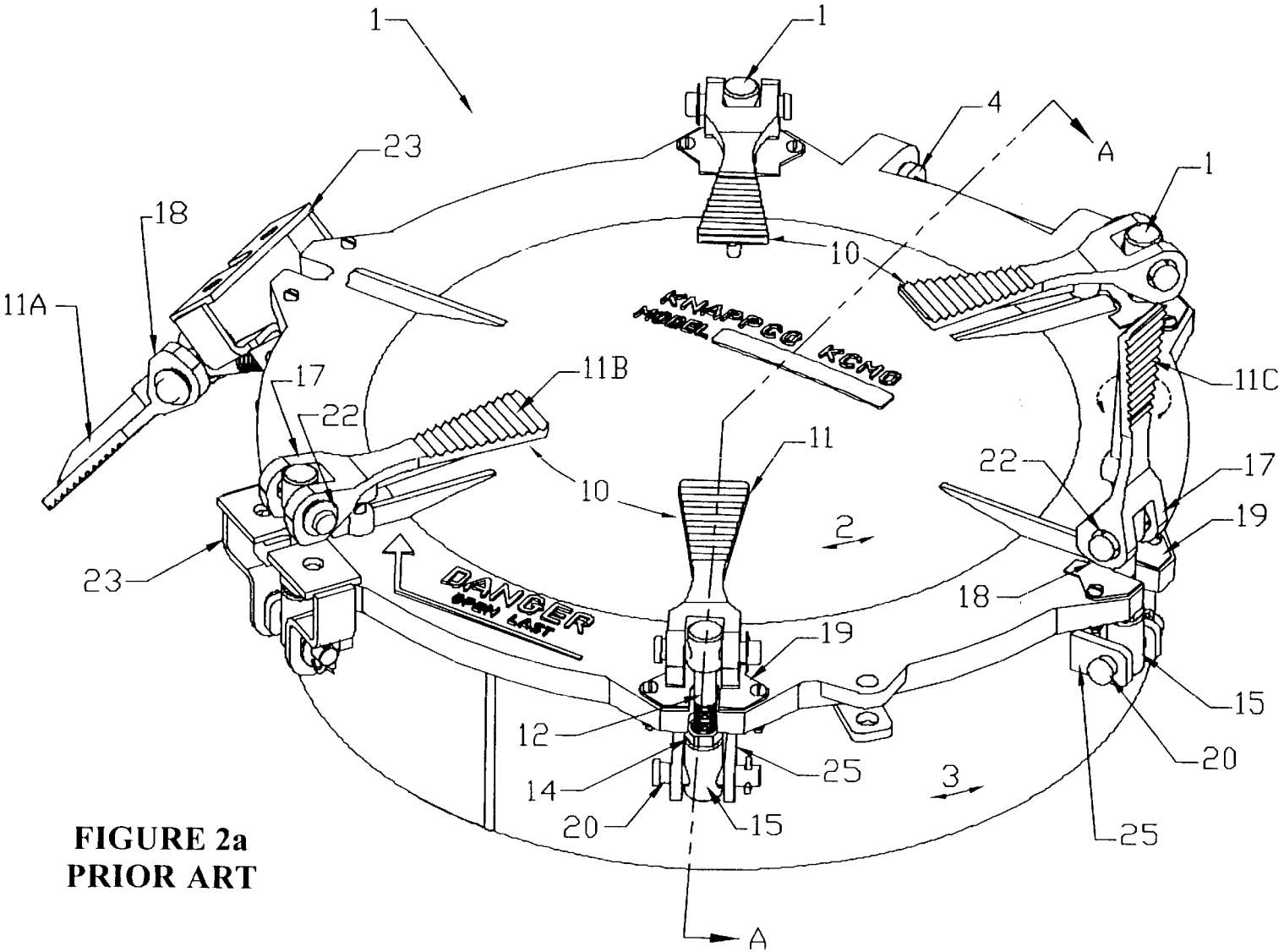
FIGURE 2a PRIOR ART
FIG. 2A is a perspective view of a prior art manhole and sealable cover.
Figure 2B:
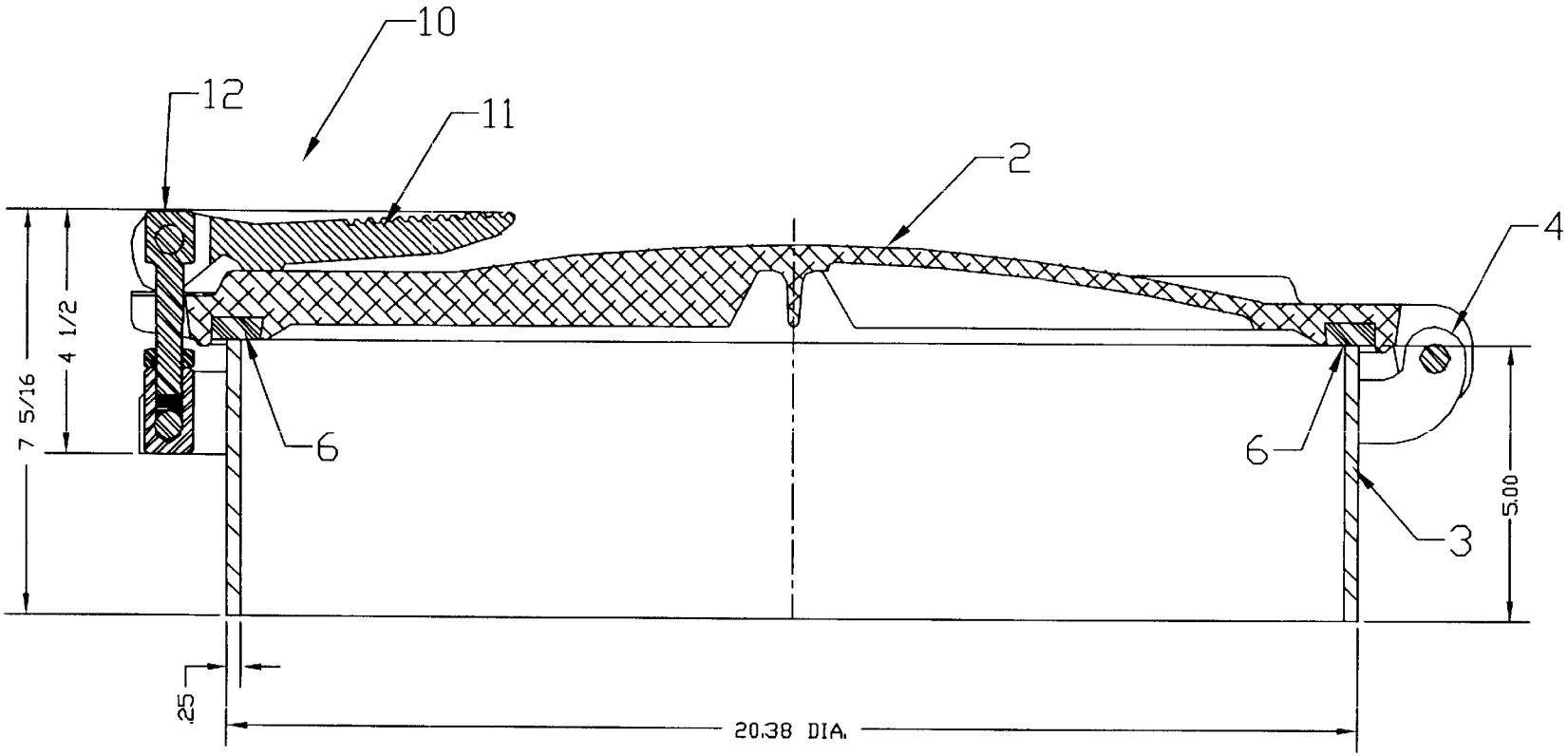
FIGURE 2b PRIOR ART
FIG. 2B is a cross-sectional view of FIG. 2A along the line A—A.
Figure 3:
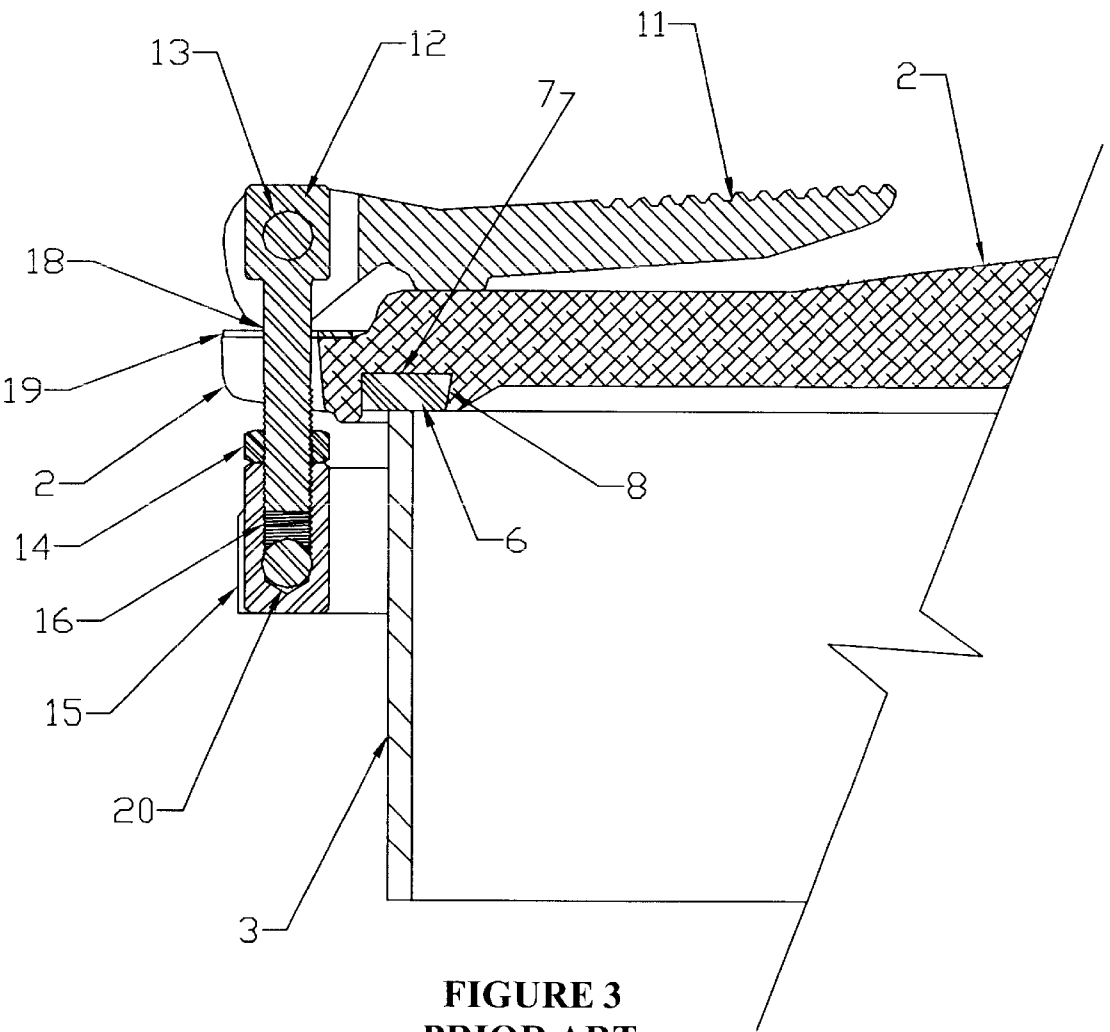
FIGURE 3 PRIOR ART
FIG. 3 is an enlarged cross-sectional view of a prior art cam lever assembly.
Figure 4:
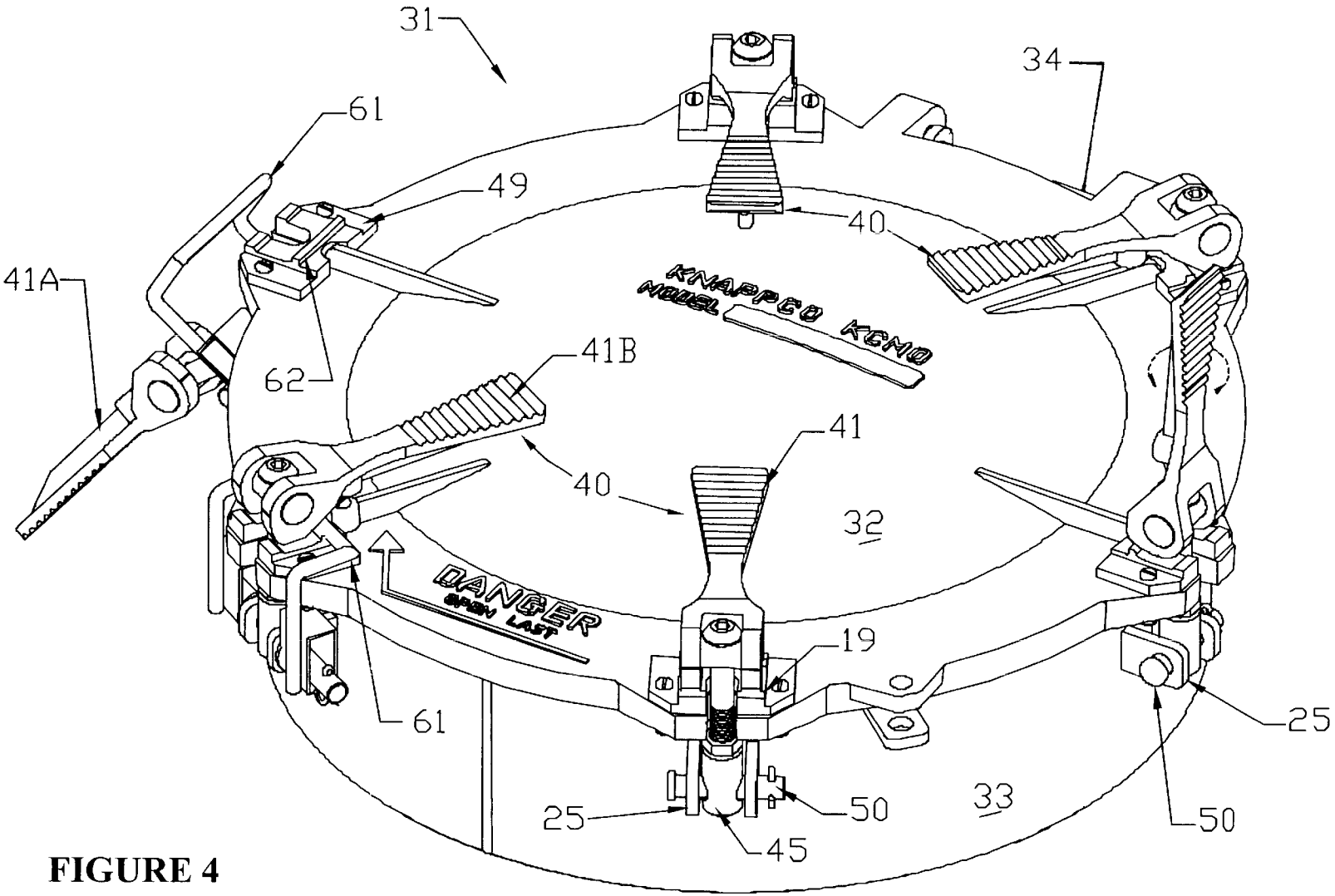
FIG. 4 is a perspective view of the manhole and sealable cover with the cam lever assembly of the present invention.
Figure 5B:
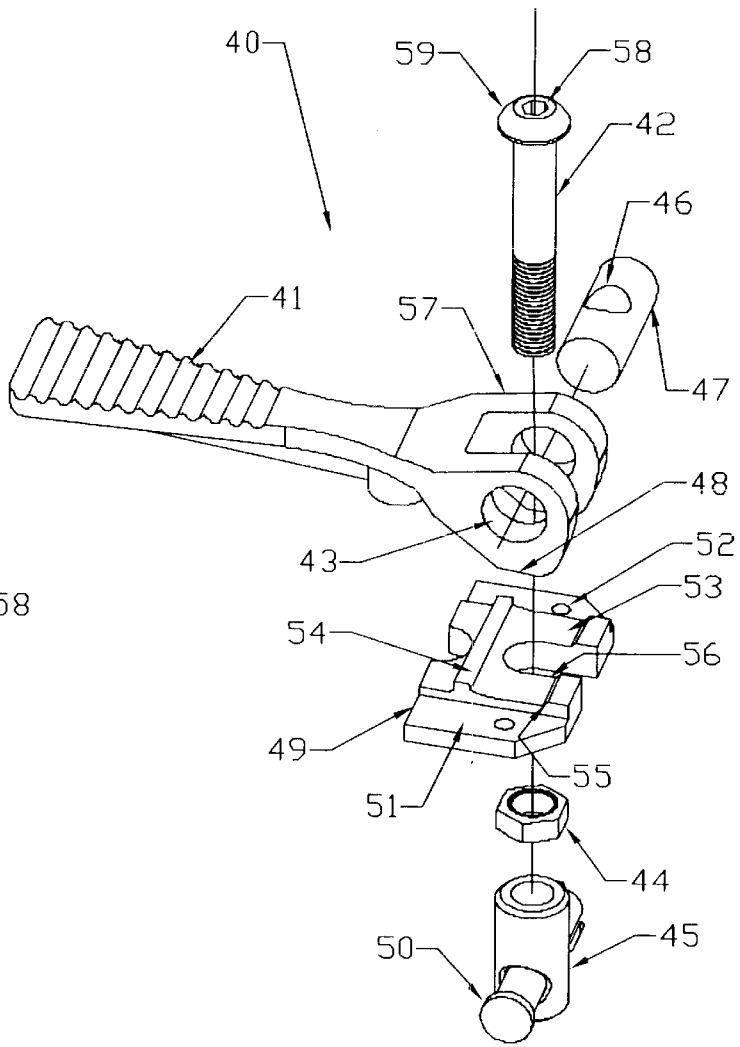
FIG. 5B is an exploded view of the cam lever assembly of FIG. 5A.
Figure 5A:
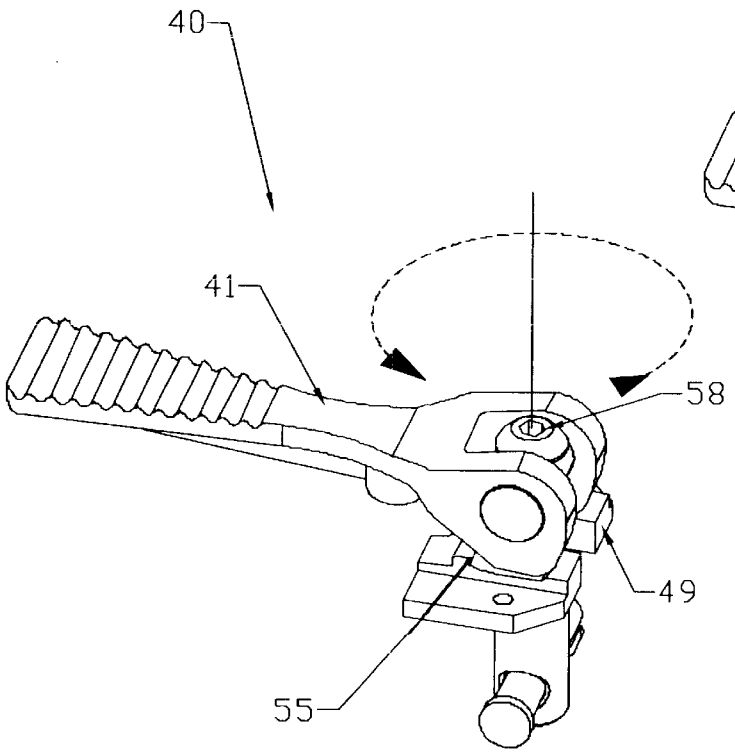
FIG. 5A is a perspective view of the cam level assembly of the present invention in isolation.

FIG. 4 illustrates manhole system 31 having the cam lever assembly 40 of the present invention. Similar to the prior art, port 31 includes a weld ring 33 and a cover 32 engaging weld ring 33. Brackets 25 will be attached to weld ring 33 and connector 45 will be pinned to brackets 25 by clevis pin 50. However, connector 45 may be "operatively attached" to weld ring 33 in any number of conventional manners as long as connector 45 may operate as required in order for cam lever assembly 40 to function properly. FIGS. 5A and 5B better illustrate the structure of cam lever assembly 40. As with the prior art, the rear of cam lever handle 41 will have a pair of prongs 57 with pivot apertures 43 formed there through. However, adjusting screw 42 engages lever handle 41 in a novel manner. Pivot pin 47 has an pin aperture 46 formed in its mid-section. When pivot pin 47 engages apertures 43, adjustment screw 42 may be inserted through pin aperture 46 and engage jam nut 44 and connector 45. Adjustment screw 42 has a head 59 which is larger than pin aperture 46. Adjustment screw 42 will also include a tool engagement surface 58 formed on head 59 which allows a tool to apply torque to screw 42. In the embodiment shown, engagement surface 58 is a polygonal aperture suitable for receiving an Allen wrench type tool. Naturally, engagement surface 58 could take any shape which allows a standard tool to apply torque to screw 42.

Cam lever assembly 40 also differs from the previously discussed prior art in that a wear plate 49 will be positioned on cover 32 (see FIG. 4) to provide a mating structure for cam surface 48. Wear plate 49 may be molded from a high strength, abrasion resistant, nylon resin such as provided by the DuPont Corporation under the trademark Zytel®. Naturally, a wide range of polymers and other materials could be used to construct wear plate 49 and all such suitable materials are within the scope of the present invention. Wear plate 49 will include a base 51 which has screw apertures 52 for securing wear plate 49 to cover 32. As seen in FIG. 5B, base plate 51 will include a sloping front cam guide 54, a sloping rear cam guide 55, and a neutral cam surface 53 positioned between can guides 54 and 55. A screw slot 56 is formed in wear plate 49 to allow adjustment screw 42 to pass through wear plate 49 and engage connector 45. Viewing FIGS. 4 and 5A, it can be visualized how the sloping front and rear cam guides 54 and 55 will assist in directing cam surface 48 on cam lever handle 41 into proper position such that when handle 41 is rotated forward, cam surface 48 will rest on neutral cam surface 53.

The advantages of the novel cam lever assembly 40 will be readily apparent to those skilled in the art. First, it is not necessary to lift cam lever handle 41 in order to turn adjustment screw 42. Rather, a suitable tool may be applied to the engagement surface 58 and screw 42 rotated while cam lever handle 41 is in the locked position. Therefore, it is never necessary to completely release pressure on a wear plate 49 when adjusting the downward force on wear plate 49. Second, it is not necessary to rotate adjustment screw 42 full turns as with the prior art adjustment screws. Adjustment screw 42 may be rotated any fraction of a turn necessary to achieve the desired downward force exerted by cam surface 48. This avoids the problem of having to rotate adjustment screw 42 a full turn and possibly damaging gasket 35.

FIG. 4 also shows a safety catch 61 similar to that described above. However, safety catch 61 is formed of a rounded bar material and rotates over wear plate 49 as suggested by viewing the safety catch 61 shown on handles 41A and 41B. Wear plate 49 has a rounded edge 62 (see wear plate 49 associated with handle 41A) against which safety catch 61 will rest. If air pressure is pushing cover 32 upward, safety catch 61 is engaged by wear plate 49 and cannot be rotated backwards.

Figure 6:
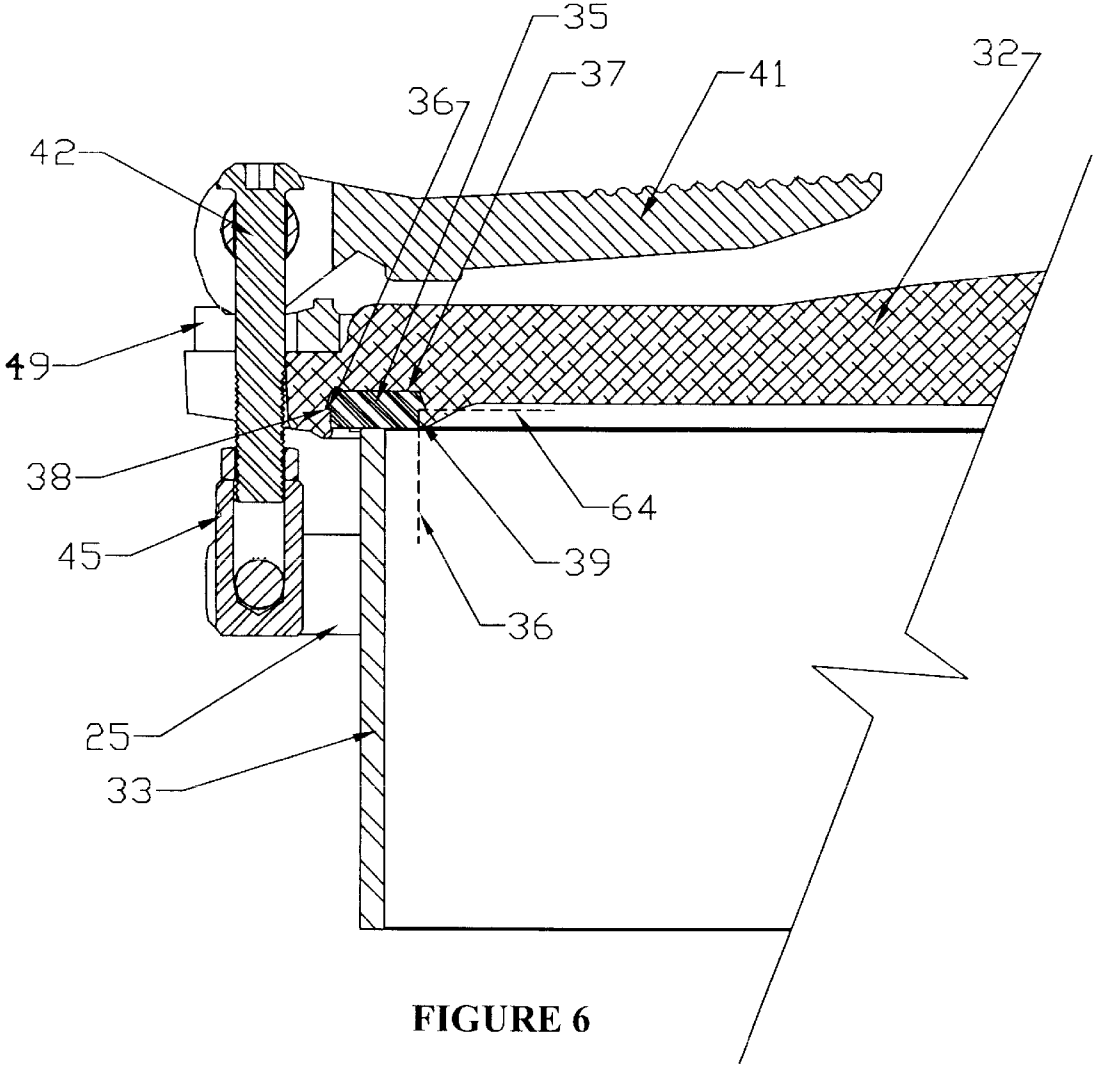
FIG. 6 is enlarged cross-sectional view of the cam lever assembly of FIGS. 5A and 5B.

Another aspect of the present invention is an improved gasket 35 and gasket channel 37 as seen in FIG. 6. Gasket channel 37 will have a channel neck 39 and channel shoulders 38 formed above neck 39, with shoulders 38 having a wider dimension than neck 39. In the embodiment of FIG. 6, shoulder 38 is shown oriented along the horizontal axis 64 (illustrated by a broken line) and neck 39 is oriented along the vertical axis 63. Thus, the orientation of shoulder 38 is approximately 90 degrees from the orientation of neck 39. However, it is within the scope of the present invention for the orientation of shoulders 38 and neck 39 to less than or more than 90 degrees. Gasket 35 will further have lips 36 which correspond in size and shape to shoulders 38. When gasket 35 is inserted within channel 37, lips 36 rest on shoulders 38 and will resist moderate tugging forces which would tend to pull gasket 35 out of channel 37. For example, any tendency of gasket 35 to stick to the upper edge of weld ring 33 would be one such moderate tugging force. However, if it was desired to replace gasket 35, it will be possible to pull gasket 35 out of channel 37 without serious difficulty. Under sufficient pulling force, gasket lips 36 will deform and slide past shoulders 38.

Although certain preferred embodiments have been described above, it will be appreciated by those skilled in the art to which the present invention pertains that modifications, changes, and improvements may be made without departing from the spirit of the invention defined by the claims. All such modifications, changes, and improvements are intended to come within the scope of the present invention.

We claim:

1. A sealable manhole system having a weld ring, a cover with a gasket shaped to engage said weld ring, and a cam lever assembly, said cam lever assembly comprising:

a. a cam lever having a cam surface and a pivot aperture;

b. a pivot pin sized to engage said pivot aperture and having a screw aperture formed there through;

c. a connector operatively attached to said weld ring; and d. an adjustment screw passing through said screw aperture and engaging said connector.

2. A sealable manhole system according to claim 1, wherein said cam lever further includes two pivot apertures such that said screw aperture is positioned between said pivot apertures when said pivot pin is inserted within said pivot apertures.

3. A sealable manhole system according to claim 1, wherein a wear plate is positioned between said cover and said cam surface of said cam lever.

4. A sealable manhole system according to claim 3, wherein said wear plate includes a front cam guide, a rear cam guide, and a cam base positioned there between.

5. A sealable manhole system according to claim 4, wherein said front cam guide and said rear cam guide slope toward said cam base.

6. A sealable manhole system according to claim 1, wherein said connector attaches to said weld ring by way of a clevis pin simultaneously passing through an aperture in said connector and a racket attached to said weld ring.

7. A sealable manhole system according to claim 6, wherein a safety catch is pivotally attached to said bracket and rotates over said wear plate to maintain said cover in a closed position.

8. A sealable manhole system according to claim 1, wherein said cover has a gasket channel with a neck and an internal shoulder formed above said neck, said internal shoulder having a dimension wider than said neck.

9. A sealable manhole system according to claim 1, where said adjustment screw has an engagement surface formed on a head of said adjustment screw.

10. A sealable manhole system according to claim 8, wherein said gasket has a lip which is sized to rest upon said shoulder when said gasket is positioned within said gasket channel.

11. A sealable manhole system according to claim 3, wherein said cam surface is formed of a polymer material.

12. A sealable manway system having a weld plate, a cover with a gasket and a cam lever assembly, said cover further comprising a gasket channel with a neck and an internal shoulder formed above said neck, said internal shoulder having a dimension wider than said neck and being oriented at an angle to said neck, said gasket having a lip which is sized to rest upon said shoulder when said gasket is positioned within said gasket channel.

13. A sealable manhole system according to claim 12, wherein said angle of orientation between said neck and said shoulder is approximately 90 degrees.

* * * * *